United States Patent [19]

Long

[11] Patent Number: 4,893,775

[45] Date of Patent: Jan. 16, 1990

[54] COPY HOLDER STAND

[76] Inventor: Roy J. Long, 8207 Bowie Dr., Omaha, Nebr. 68114-1525

[21] Appl. No.: 285,426

[22] Filed: Dec. 16, 1988

[51] Int. Cl.[4] ..... A47F 37/14

[52] U.S. Cl. ..... 248/442.2; 248/447; 248/918; 400/718

[58] Field of Search ..... 248/444.2, 444.1, 447, 248/455, 1 A, 1 B, 1 C, 1 I, 460, 441.1, 458; 400/718

[56] References Cited

U.S. PATENT DOCUMENTS

| | | | |
|---|---|---|---|
| 728,646 | 5/1903 | Wood | 248/442.2 |
| 2,006,887 | 7/1935 | Doherty | 248/442.2 X |
| 2,146,465 | 2/1939 | Coppock | 248/442.2 |
| 2,505,814 | 5/1950 | Voorhorst | 248/442.2 |
| 2,574,575 | 11/1951 | MacIntyre | 248/442.2 X |
| 4,436,271 | 3/1984 | Manso | 248/460 |
| 4,546,947 | 10/1985 | Gesten | 248/442.2 |
| 4,635,893 | 1/1987 | Nelson | 400/718 X |

*Primary Examiner*—Ramon O. Ramirez
*Attorney, Agent, or Firm*—Larson and Taylor

[57] ABSTRACT

A copy holder stand for use in transcribing copy material into a computer. The stand is, in use, disposed between the computer keyboard and the cathode-ray tube of the computer, and thereby allows the user to conveniently view the CRT and the copy material. The copy holder stand is equipped with a forwardly inclinable copy holder back which allows easy access to the computer disk drives. A brace maintains the copy holder back in a generally upright position in which the back is used to hold the copy material.

3 Claims, 3 Drawing Sheets

COPY HOLDER STAND

BACKGROUND OF THE INVENTION

1. Field of the Invention

The present invention relates to the field of copy holders for holding materials to be read and typed, and in particular, to a copy holder stand used in conjunction with a computer having a detached keyboard.

2. Description of the Prior Art

Computers and word processing workstations have proliferated in recent years. To utilize the computer, it is frequently necessary to transcribe information from copy material such as books and papers and input that information into the computer for subsequent processing. To this end, a computer operator is typically assigned to read the input copy material and enter that information into the computer via the computer keyboard.

Numerous copy holder stands have been described in the prior art which attempt to facilitate this transcription procedure. These copy holders generally provide for supporting the copy material in an upright position next to the computer.

Prior art copy holder stands generally have one or more disadvantages. Most copy holders cannot be positioned between the computer keyboard and CRT, and, instead must be placed to one side of the computer. Therefore, the computer operator must constantly look to the left or right to view the copy. This leads to neck and back strain, and can result in inefficient work and a less than satisfactory work product. Other disadvantages of currently available copy holders include their inability to support large or heavy copy and their inability to allow easy access to the computer disk drives. In this regard, prior art copy holders, when used in conjunction with a computer, generally do not provide a large sturdy surface for copy holding and do not allow easy access to the computer disk drive when inserting or removing disks.

The patented art in this field includes the following U.S. Pat. Nos.: 4,436,271 (Manso); 4,518,140 (Ferranto); 4,709,895 (Marduck); 4,522,364 (Charney et al); 4,313,112 (Foster); 4,546,947 (Gesten).

The Manson, Ferranto and Marduck patents all disclose typical inclinable copy holders. All are designed to be rearward inclinable rather that forwardly inclinable, and all have obtrusive rear braces which prevent their placement between a computer keyboard and CRT.

The Charney et al patent discloses a desk top which is inclinable. This patent mentions that copy material or reading material must be positioned at the proper angle and distance from the reader so to avoid damaging eye strain.

The Foster patent discloses a computer workstation assembly which includes a copy holder positioned between the computer keyboard and the computer CRT. This copy holder is not inclinable, and is, in fact, permanently disposed at a low angle so that the computer operator has no choice but to view the copy from a potentially awkward angle.

The Gesten patent discloses a keyboard dust cover having an integral copy holder. The device attaches to the rear of a computer keyboard and allows a copy to be placed between the computer keyboard and CRT. The device is forwardly inclinable, and thus allows access to the computer disk drives. However, because the copy holder of this patent must be attached to the rear of the computer keyboard, there is a limit to the size and weight of any copy supported thereby and large, heavy copy will not balance properly on the keyboard. Furthermore, the mounting arrangement for the copy holder cannot be used with any current or future keyboard design. In addition, the mounting arrangement could cause wear or damage to the rear surface of the keyboard. Further, because this copy holder must be mounted to a keyboard, it can not be used in the absence of the keyboard and therefore is limited in its possible applications.

In summary, as mentioned above, in order for a copy holder to be used efficiently with a computer, it is desirable that the copy holder be placed between the computer keyboard and CRT. This allows the user to see either the keyboard, the CRT or the copy material without having to look to the left or right. This is important to prevent strain to the spinal cord and neck which can result from bending or twisting the neck to a fixed position over a period of time. While some prior art copy holders can be positioned between a computer keyboard and CRT these devices do not permit convenient access to the computer disk drive and do not provide for the support of large, heavy copy.

SUMMARY OF THE INVENTION

It is an object of this invention to provide a copy holder for use with a computer or word processing work station wherein any copy to be transcribed is conveniently positioned between the computer keyboard and CRT.

It is also an object of this invention to provide a copy holder which can be placed between a computer keyboard and CRT yet still allow for easy access to the computer disk drives.

It is also an object of this invention to provide a copy holder which can support of large or heavy copy material, such as books.

It is also an object of this invention to provide a copy holder which can be used with any computer having a detached keyboard.

It is a further object of this invention to provide a copy holder for use with a computer which will not, in use, damage or disfigure the computer.

It is also an object of this invention to provide a copy holder having a lipped shelf for supporting copies.

These and other objects are achieved, and the disadvantages of the prior art are overcome, by a copy holder constructed in accordance with the present invention which comprises a copy holder stand with a forwardly inclinable copy support which can be positioned between a computer keyboard and CRT.

In accordance with a preferred embodiment thereof, the copy holder stand of the invention comprises support apparatus for supporting copy material such that the copy material can be disposed between a computer and the keyboard of the computer, and such that access is provided to the disk drives of the computer. The copy holder stand includes a base having an upwardly extending support member, with the base being constructed such that the base can be disposed beneath a computer. A movable copy holder back is attached by means of a hinge to the support member and is pivotable between a first, generally upright, position and second, lowered, position wherein access is provided to the computer disk drives. A shelf is provided which supports copy material while the movable back is disposed in the generally upright position. The shelf also serves to support the movable back when the back is disposed in the lowered position. Further, a brace, mounted on the upwardly extending support member, serves to support the movable back while the back is in the generally upright position.

As noted above, the shelf can be provided with a lip to hold the copy materials in place. This lip can be eliminated from the shelf in embodiments which are designed to support large books and manuals. The elimination of the lip from the shelf allows the pages of a book or manual to be turned in an easy manner.

Other objects, features, and advantages of the invention will be set forth in, or be apparent from, the detailed description of the preferred embodiments of the invention which follows.

DETAILED DESCRIPTION OF THE PREFERRED EMBODIMENTS

Figure 1:
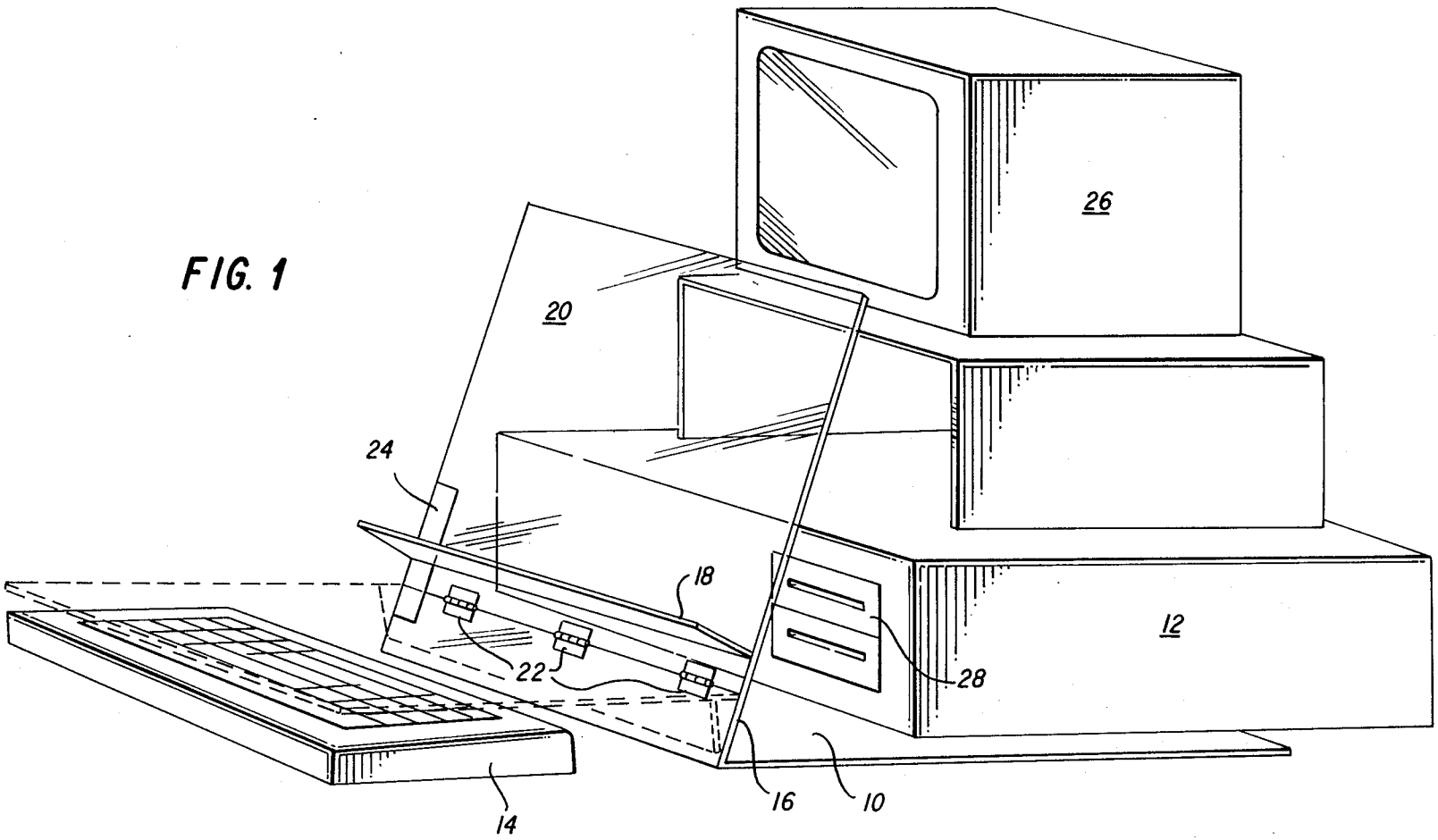
FIG. 1 is a front perspective view of a first embodiment of copy holder stand device constructed in accordance with the present invention and illustrating, in phantom lines, the movable back of the copy holder disposed so to allow access to the computer disk drive.
Figure 2:
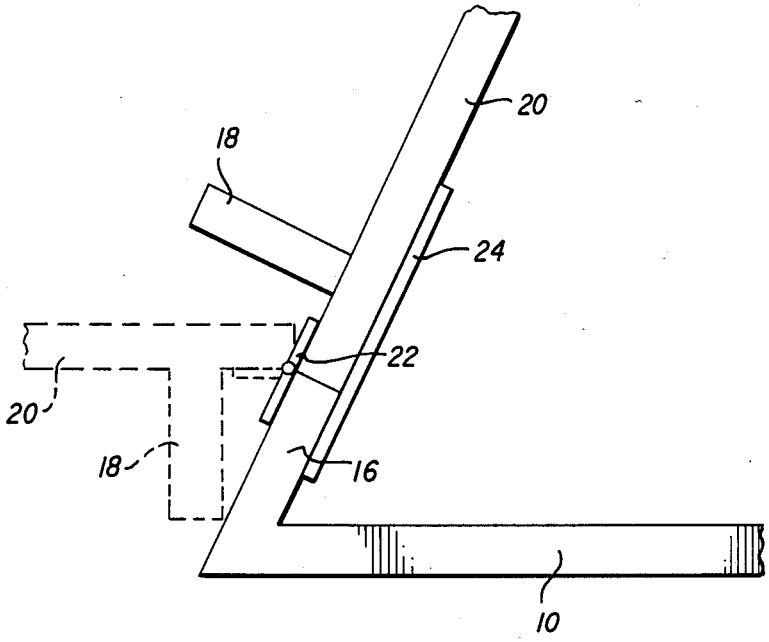
FIG. 2 is a partial side elevational view of the first embodiment of a copy holder stand device constructed in accordance with the present invention and illustrating, in phantom lines, the position of the movable back which permits access to the computer disk drive.

Referring to FIGS. 1 and 2, a first embodiment of the copy holder stand of the present invention will now be described. The copy holder stand includes a base 10 which, in use, is disposed beneath a computer 12, and behind the computer keyboard 14. This base 10 generally comprises a planar rectangular member.

An upwardly extending support member 16 is attached to the base 10 and is, in use, disposed adjacent to the computer keyboard 14 so as to extend along the rear thereof, as illustrated. In a preferred embodiment of this invention, the support member 16 and the base 10 form an acute angle of between about 70 and 85 degrees and in a specific embodiment, of about 77 degrees.

The upwardly extending support member 16 provides support for a movable pivotable copy holder back 20 which carries a shelf 18 for receiving copy (not shown). The movable copy holder back 20 is attached by means of a series of spaced hinges 22 to the upwardly extending support member 18 such that the back 20 is movable between a first, generally upright, position shown in solid lines and a second, lowered, position shown in phantom lines. The shelf 18 extends perpendicular to, and is attached near the bottom of, the movable copy holder back 20. Attached in this manner, the shelf 18 serves several functions, viz: (1) the shelf 18 supports copy material while the movable copy holder back is in the upright position; (2) the shelf 18 limits the forward motion of the movable copy holder back 20; and (3) the shelf 18 supports the movable copy holder back 20 horizontally above the keyboard 14.

A brace 24 is affixed to one end of the support member 16 so as to extend into the path of movement of the copy holder back 20 and support the movable copy holder back 20 while the latter is positioned upright.

The computer includes a cathode-ray tube (CRT) 26 which, in use, is elevated a sufficient height above the computer 12 so to allow a clear view of the CRT 26. This may be accomplished by any means such as a commercially available U-shaped stand.

Considering the manner in which the copy holder stand device of the invention is used, when the computer 12 is not being used, the stand is normally disposed with the movable copy holder back 20 in the lowered position. In this position the movable copy holder back 20 protects the keyboard 14 from dust, spilled drinks, or the like.

Prior to transcribing any copy material, the computer operator can insert a disk into a disk drive 28 of the computer. When the operator is ready to transcribe, the operator rotates the movable copy holder back 20 to the generally upright position thereof such that the back 20 rests against the brace 24. The operator then places the copy material onto the shelf 18 so as to rest against the movable copy holder back 20. The operator can now easily view either the keyboard 14, the CRT 26 or the copy material without bending or twisting his or her neck.

Should it be necessary to replace the disk in the computer disk drive 28 the operator simply removes the copy material from the copy holder and rotates the movable copy holder back 20 forwardly to the original, lowered, position. The operator then has convenient access to the computer disk drive 28. Once the operator has replaced the disk in the disk drive 28, the operator rotates the movable copy holder back 20 to the upright position, and returns the copy material to the shelf 18.

Finally, when the operator has completed transcribing the copy material, the operator removes the copy material from the copy holder device. The operator may then choose to leave the movable copy holder back 20 in the upright position or to return the movable copy holder back 20 to the lowered position where it protects the keyboard.

Figure 3:
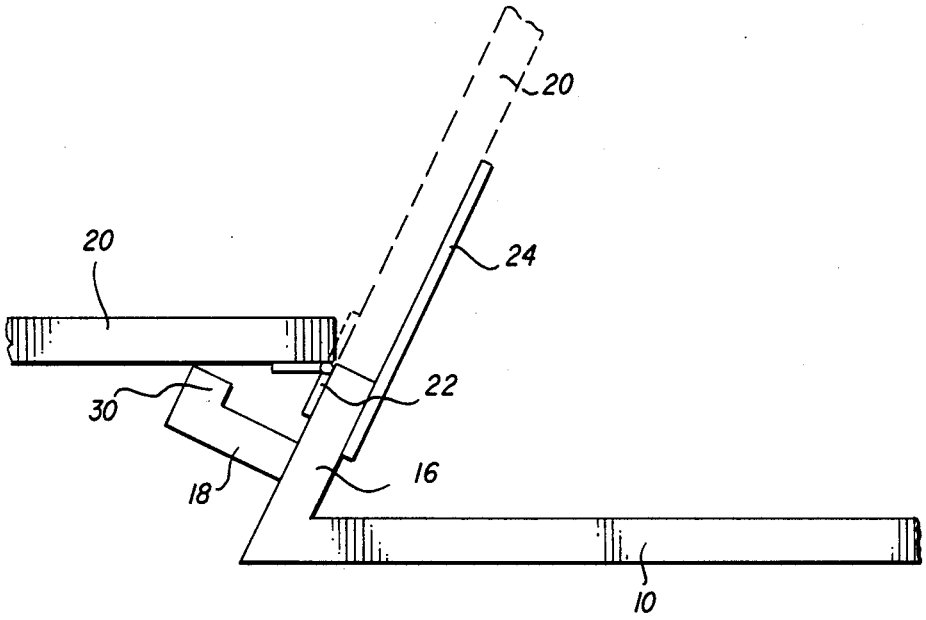
FIG. 3 is a partial side elevational view of a second embodiment of a copy holder stand device constructed in accordance with the present invention and illustrating, in phantom lines, the position of the movable back which provides support of copy material.

In the second embodiment of the invention, shown in FIG. 3, the copy holder device is identical to the embodiment shown in FIG. 1 except that; (1) the shelf, denoted 18, is affixed to the upwardly extending support member 16 instead of to the movable copy holder back 20; and (2) the shelf includes a lip 30 which extends vertically along the forward edge of the shelf. In this embodiment, it is preferable that the shelf 18 and lip 30 be sized and positioned such that when the movable copy holder back 20 is disposed in the lowered position thereof, the movable copy holder back 20 will rest on the lip 30 and thereby be supported above the computer keyboard 14. Also, the lip 30 should be of sufficient height to prevent copy material that is disposed on shelf 18 from slipping off of shelf 18. When the shelf is going to be used to support large books or manuals the lip 30 is not essential for the proper function of the shelf 18, and in embodiments designed for this purpose the lip 30 can be eliminated. In embodiments that eliminate the lip from the shelf, a small brace (not shown) can be added to the left end of the shelf to support the copy holder 20 when the copy holder is brought forward over the keyboard. This brace should be sized so as to prevent the copy holder from touching the keyboard when the copy holder 20 is in the forward or down position.

In both embodiments, it is preferred that the copy holder stand device be constructed of generally transparent material.

Although the invention has been described with respect to exemplary embodiments thereof, it will be understood by those skilled in the art that variations and modifications can be effected in these exemplary embodiments without departing from the scope or spirit of the invention.

I claim:

1. A copy holder stand device for use with a computer including a keyboard, said device comprising:

a planar base adapted to be disposed beneath a computer and behind the computer keyboard;

an upwardly extending support member attached to the front edge of said base;

a movable copy holder back against which, in use, materials to be copied rest;

a hinge means for attaching said movable copy holder back to said upwardly extending support member, said hinge means including a generally horizontal pivot axis for providing pivoting of said movable copy holder back between a first position in which said movable copy holder back projects forwardly and horizontally and a second position in which said movable copy holder back extends upwardly and rearwardly, and forms an extension of said upwardly extending support member so that materials to be copied can rest thereon; and abutment means for limiting the degree of motion of said movable copy holder back between said first position and said second position, said abutment means comprising, a shelf mounted perpendicular to, and intermediate to, said upwardly extending support member, the front of said shelf being of the same height as the top of said upwardly extending support member and adapted to maintain the movable copy holder back in said first, generally horizontal, position, and a brace attached parallel to the rear surface of, and extending above, the upwardly extending support member, and adapted to maintain the movable copy holder back in said second, generally upright position.

2. The apparatus of claim 1 wherein said shelf includes a lip comprising an elongated rectangular member secured vertically along the length of the forward edge of said shelf and perpendicular thereto and with said shelf positioned on said upwardly extending support member such that the top of said lip is at the same height as the top of said upwardly extending support member.

3. The apparatus of claim 1 wherein the copy holder is constructed of a generally transparent material.

* * * * *